US006380895B1

(12) United States Patent
Moren et al.

(10) Patent No.: US 6,380,895 B1
(45) **Date of Patent: *Apr. 30, 2002**

(54) TRAP MICROSTRIP PIFA

(75) Inventors: Stefan Moren, Kista (SE); Corbett Rowell, Clear Water Bay (HK)

(73) Assignee: Allgon AB, Åkersberga (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/462,086

(22) PCT Filed: Jul. 7, 1998

(86) PCT No.: PCT/SE98/01341

§ 371 Date: Apr. 6, 2000

§ 102(e) Date: Apr. 6, 2000

(87) PCT Pub. No.: WO99/03168

PCT Pub. Date: Jan. 21, 1999

(30) Foreign Application Priority Data

Jul. 9, 1997 (SE) ..... 9702659
May 14, 1998 (WO) ..... PCT/SE98/00899

(51) Int. Cl.[7] ..... H01Q 1/38
(52) U.S. Cl. ..... 343/700 MS; 343/822
(58) Field of Search ..... 343/700 MS, 822, 343/725, 751

(56) References Cited

U.S. PATENT DOCUMENTS 5,400,040 A * 3/1995 Lane et al. ..... 343/700 MS
5,764,190 A * 6/1998 Murch et al. ..... 343/702
5,926,139 A * 7/1999 Korisch ..... 343/702

FOREIGN PATENT DOCUMENTS

| | | |
|---|---|---|
| EP | 0749176 | 12/1996 |
| SE | 9702659-5 | 7/1997 |
| WO | WO96/27219 | 9/1996 |

* cited by examiner

*Primary Examiner*—Don Wong
*Assistant Examiner*—James Clinger
(74) *Attorney, Agent, or Firm*—Jacobson Holman, PLLC

(57) ABSTRACT

The present invention relates to a small microstrip antenna device, mountable inside a hand-held radio communication device, for receiving and transmitting RF signals in one or more frequency bands. The microstrip antenna comprises a ground plane means (101), at least a first feeding means (107) and N radiating elements where N is an integer greater than zero. The microstrip antenna structure also has a first conductive path (104). The feeding means is arranged on the first patch for feeding radio frequency signals to the N radiating elements, wherein at least a first of the N radiating elements has a second patch (106). The second patch is inductively coupled (108) to the first patch.

23 Claims, 6 Drawing Sheets

TRAP MICROSTRIP PIFA

CROSS-REFERENCE TO RELATED APPLICATIONS

This application is based on the Swedish patent application SE 9702659-5 'Compact Antenna Device' which is hereby incorporated by reference and the international patent application PCT/SE98/00899 'Compact Antenna Device' which is hereby incorporated by reference. Both applications have the same applicant as the present invention.

1. Technical Field of Invention

The present invention relates in general to an antenna structure and more specifically to a microstrip antenna structure.

2. Description of Related Art

With the recent advances in mobile communication, there has been tremendous interest in development of small size and low profile antennas for the further miniaturization of mobile radio communication equipment. Goals include small size, low profile, low cost and ease of manufacturing. Frequencies of interest can for instance be 900 MHz band antennas for applications in cellular handheld radio devices such as GSM (890–935 MHz), indoor cordless telephones such as the European CT1+ (886–931 MHz) and 1.9 GHz band antennas for applications in DECT (1.89 GHz) and PCS (1.8 GHz). These systems have their own requirements in antenna characteristics, such as resonant frequency, bandwidth, gain etc.

Existing antennas used in mobile phones include the most common whip antennas (monopole), microstrip patch antennas and planar inverted-F antennas. Microstrip patch antennas and planar inverted-F antennas are typically low-profile antennas. Although the microstrip patch antenna previously has had the shortcoming of narrow bandwidth and low efficiency, its advantages of low profile, small size and light weight are attractive properties.

However both planar inverted-F antennas and microstrip patch antennas exhibit size problems when they should be adjusted for the specific frequencies and fit into the newer generation of miniature mobile radio communication devices. This is particular problematic when modern mobile phone design calls for multiple antennas to be placed into one handset to be able to simultaneously communicate in two different systems, in a very broad frequency band or more generally to take advantage of antenna diversity.

EP 749 176'Planar and non-planar double C-patch antennas having different aperture shapes' discloses a patch antenna. The C-patch antenna includes a truncated ground plane, a layer of dielectric material having a first surface overlaying the ground plane and an opposing second surface, and an electrically conductive layer. The conductive layer forms a radiating patch and has a non-rectangular aperture.

Wo 96/27219'Meandering inverted-F antenna' discloses an inverted F-antenna with a meandering pattern. The antenna is a planar radiating structure having alternating cutouts along a longitudinal dimension of a planar radiating element or patch which is parallel to a nearly coextensive ground plane.

SUMMARY OF INVENTION

The object of the present invention is thus to achieve a small microstrip antenna device, mountable inside a hand-held radio communication device, for receiving and transmitting RF signals in one or more frequency bands.

The problems described above, with how to achieve an antenna which is mountable inside and hand-held radio communication device is solved by providing a microstrip antenna comprising a ground plane, at least a first feeding means and N radiating elements where N is an integer greater than zero. The micro strip antenna structure having a first conductive patch. The feeding means being arranged on the first patch for feeding radio frequency signals to the N radiating elements, at least a first of the N radiating elements having a second substantially rectangular patch. The second patch being inductively coupled to the first patch and the second patch having a free end.

In more detail the objects of the present invention according to one embodiment, is achieved by providing the above mentioned microstrip antenna structure wherein at least one of the N radiating elements having a capacitive coupling to ground in the free end.

In more detail the objects of the present invention according to one embodiment, is achieved by providing the above mentioned microstrip antenna wherein, the first and second patch being thin conductive layers on a dielectric substrate. The substrate comprising at least first and second protrusions arranged for retaining a component in electric contact with the first and second patch.

An advantage with the present invention is that a small microstrip antenna structure is achieved which is suitable for mounting inside a hand-held radio communication device.

Another advantage with the present invention is that the antenna structure can be tuned to be responsive to multiple frequencies.

An advantage, according to one embodiment of the invention, is that the antenna structure can be achieved with a choice of using discrete components or not.

An advantage, according to one embodiment of the invention, is that the antenna structure may be implemented directly on the inside of a back cover of a hand-held radio communication device.

Further scope of applicability of the present invention will become apparent from the detailed description given hereinafter. However, it should be understood that the detailed description and specific examples, while indicating preferred embodiments of the invention, are given by way of illustration only,- since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention and wherein.

DETAILED DESCRIPTION OF PREFERRED EMBODIMENTS

Figure 1:
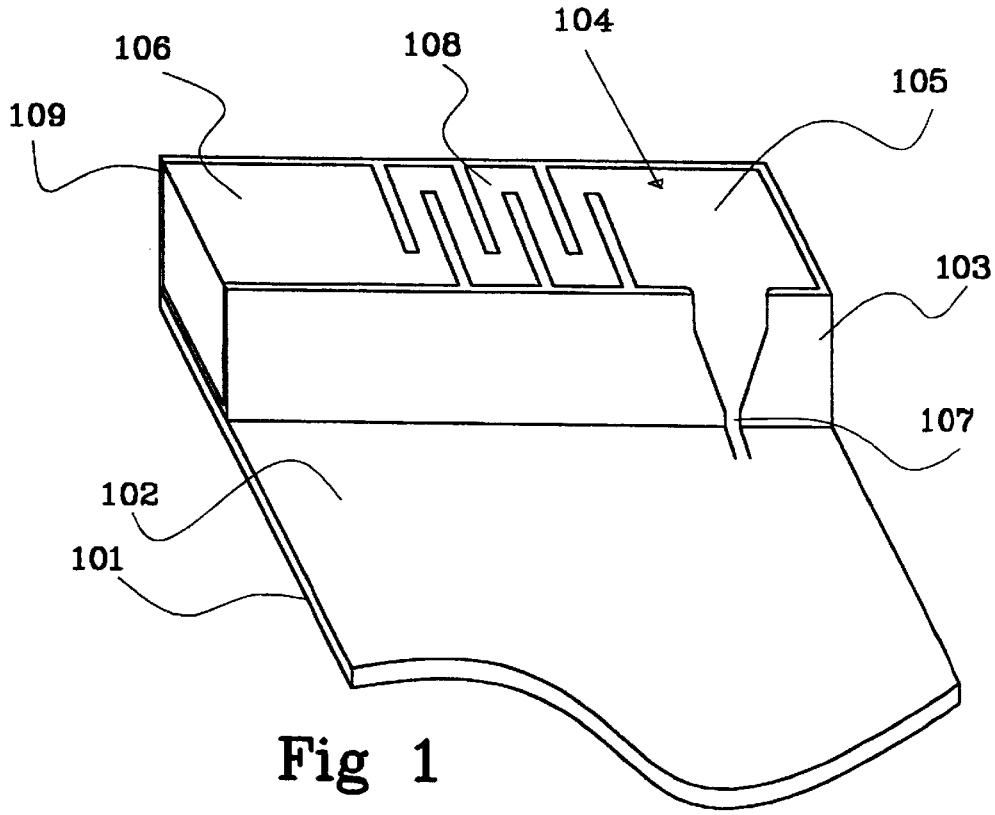
FIG. 1 shows a schematic, perspective view according to a first preferred embodiment of the invention.

FIG. 1 shows a schematic, perspective view according to a first preferred embodiment of the invention. A ground plane is denoted 101 and applied to the backside of a printed circuit board 102. A dielectric substrate is denoted 103 and is acting as a carrier for a radiating structure 104. The radiating structure 104 is, in this preferred embodiment, a conductive pattern, which can be achieved with for instance MID-technique (Molded Intrusion Design) which is a technique well known to the skilled man in the art. Another possibility is to use a conductive pattern, screen printed on an adhesive flexible film.

The radiating structure 104 comprises a first patch 105 and a second patch 106. The first patch 105 comprises feeding means 107 for feeding an RF signals to the radiating structure. The first patch 105 is connected to the second patch 106 through a meandering pattern 108. The meandering pattern 108 acts as a inductive connection between the first and second patches 105 and 106. The inductance is determined by the number of turns and the width of the meandering pattern 108. The second patch 106 is folded over the edge 109 and continues towards the ground plane 101 to effectively achieve a capacitive coupling between the second patch 106 and the ground plane 101. A capacitive coupling is, of course, also existing between the first patch 105 and the second patch 106, and the capacitance is determined by the distance between the two patches.

Figure 2:
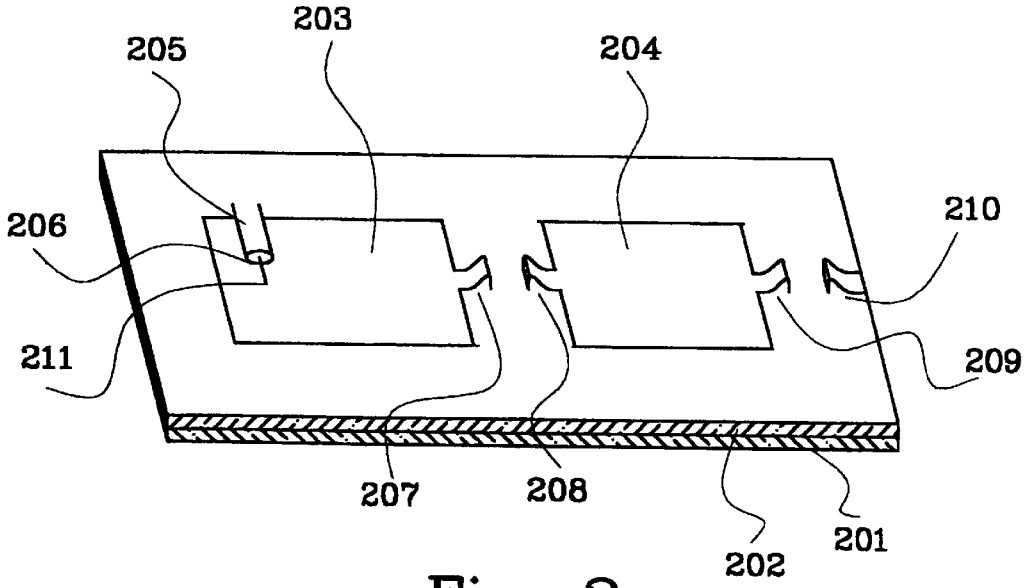
FIG. 2 shows a schematic, perspective view according to a second preferred embodiment of the invention.

FIG. 2 shows a schematic, perspective view according to a second embodiment of the invention. A ground plane is denoted 201 and a dielectric substrate is denoted 202, a first patch is denoted 203 and a second patch is denoted 204. A feeding means in the form of a coaxial cable is denoted 205. The shield of the coaxial cable is connected to the first patch 203 at a first connection point 206 and the feed of the coaxial cable is connected to the first patch 203 at a second connection point 211. The distance between the first and second connection point is determining the input reactance. The dielectric substrate comprises first, second, third and fourth protrusions denoted 207, 208, 209 and 210, respectively. The first patch 203 comprises a conductive strip folded over the first protrusion 207 and the second patch comprises a conductive strip folded over the second protrusion 208. The first and second protrusions are arranged for retaining a discrete component, such as for instance a coil or more generally an inductance, in electrical contact with the first and second patch. The discrete component is not shown in FIG. 2 for sake of clarity. The protrusions are somewhat flexible or resilient so a contact force is established between the folded strip and the discrete component on respective side. It is of course also possible to solder the discrete component to achieve even better retaining capabilities.

The second patch 204 comprises a second conductive strip folded over the third protrusion 209 and the ground plane also comprises a conductive strip folded over the protrusion 210. Thus can a discrete component, such as a capacitor (not shown), be retained between the third and fourth protrusions in electric contact with the second patch 204 and the ground plane 210.

Figure 3B:
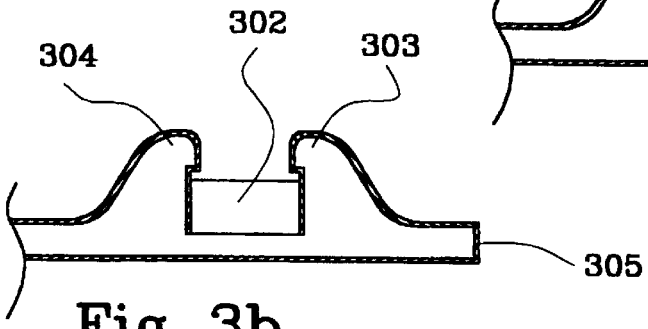
FIGS. 3*a*, 3*b* and 3*c* shows schematic views of a retainer arrangement according to a preferred embodiment of the invention.
Figure 3C:
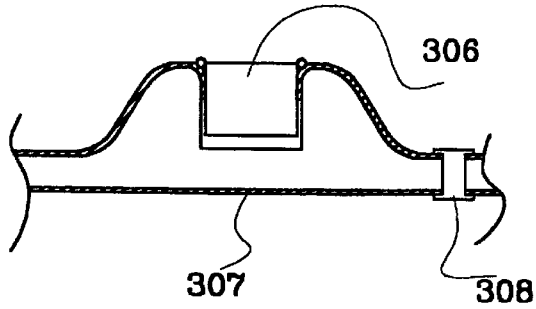
Figure 3A:
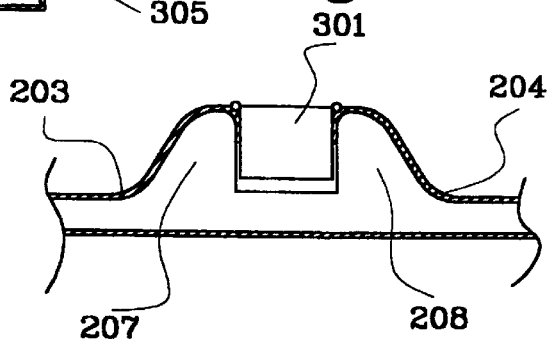

FIGS. 3*a*, 3*b* and 3*c* show schematically in a closer view different variants of the retainer arrangement in FIG. 2. In FIG. 3*a* a discrete component is illustrated which can be a coil, active inductor, tunable inductor or other inductive means, denoted 301. The first patch 203 with the conductive strip folded over the first protrusion 207 is soldered to the component 301. The second patch 204 is folded over the second protrusion 208 and soldered to the component 301.

In FIG. 3*b* a different retainer arrangement is disclosed where the resilient or flexible characteristics of the dielectric substrate are fully used. In this embodiment, no soldering is required. When the discrete component 302 is pushed down in the retainer the first and second protrusion 303 and 304 flexes back so as to let the component 302 to pass. Once the component is in the retainer the protrusions resumes their original positions effectively retaining the component 302 through the small cutouts in the protrusions. In FIG. 3*b*, a ground plane 305 is folded over an edge and again over the second protrusion 303 to achieve electrical contact between the ground plane 305 and the component 303.

In FIG. 3*c* the electrical contact between a component 305 and a ground plane 307 is achieved through a connector means 308.

Figure 4A:
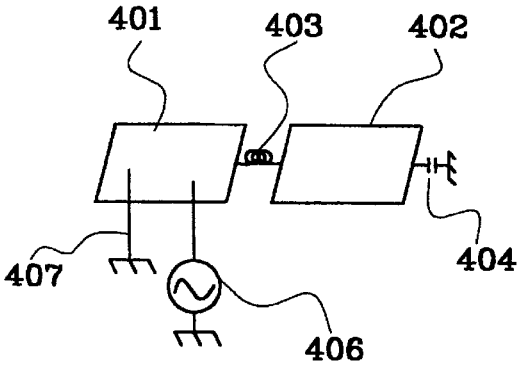
FIGS. 4*a* and 4*b* show diagrammatic views according to a second embodiment of the invention.
Figure 4B:
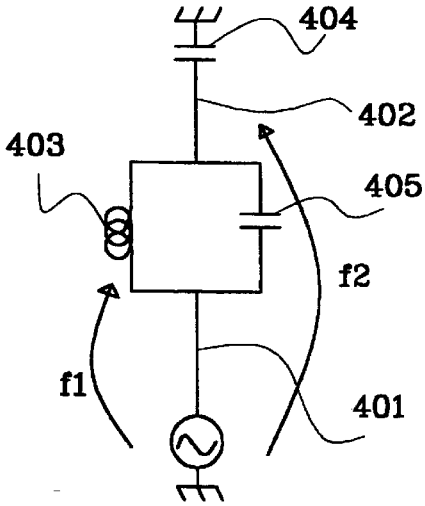

FIG. 4*a* shows a first diagrammatic view and FIG. 4*b* a second diagrammatic view according a preferred embodiment of the invention. A first patch is denoted 401, a second patch is denoted 402 and an inductive coupling between the first and second patch is denoted 403. A first capacitive coupling between the second patch and ground is denoted 404 and a second capacitive coupling between the first and second patch is, in FIG. 4*b*, denoted 405. A signal generator is denoted 406 and a ground connection is, in FIG. 4*a*, denoted 407. The radiating structure is adjusted to have first resonance frequency f1 for which the inductance 403 and the second capacitance 405 effectively act as an open circuit where substantially only the first patch is radiating FR signals. For a second resonance frequency f2 the inductance 403 and the second capacitance 405 effectively act as a short circuit and substantially both the first and second patches radiate RF signals as one antenna element. Thus, the combined inductive and capacitive coupling between the first and second patch act as a trap preventing signals within a specific frequency band to pass the coupling.

Figure 5A:
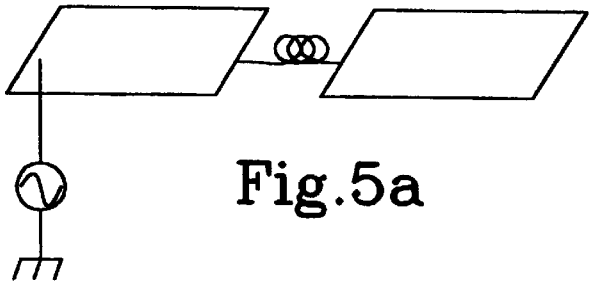
FIG. 5 shows a diagrammatic view according to a third embodiment of the invention.
Figure 5B:
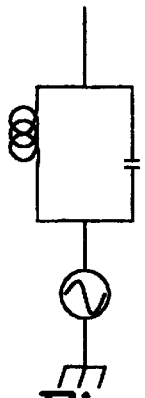

FIGS. 5*a* and 5*b* shows diagrammatic views according to a third preferred embodiment of the invention where no top capacitance is used.

Figure 6A:
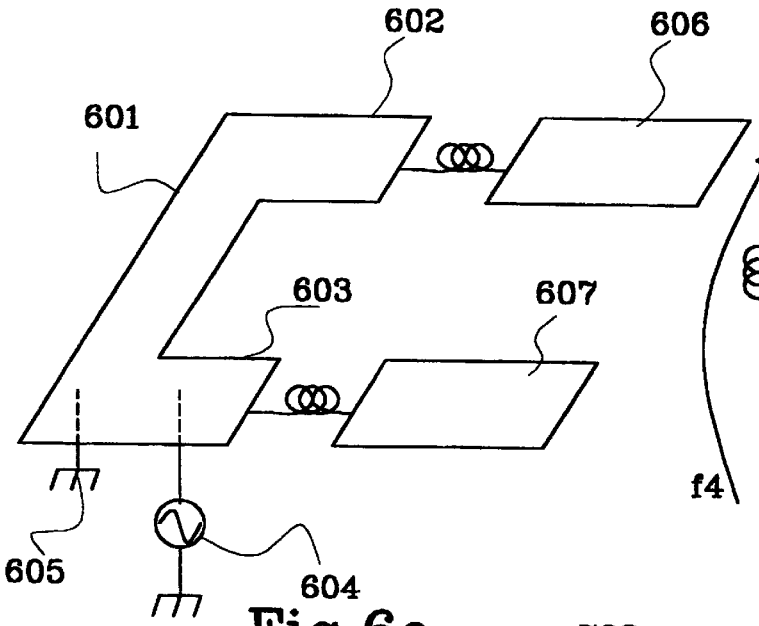
FIGS. 6*a*, 6*b* shows diagrammatic views of different variants according to a fourth embodiment of the invention.
Figure 6B:
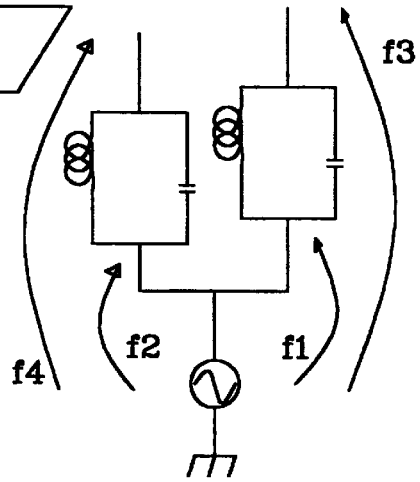

FIGS. 6*a* and 6*b* show diagrammatic views according to a fourth embodiment of the invention. A first patch is denoted 601 having first and second protruding parts 602 and 603 respectively. Feeding means for feeding RF signals to the radiating structure is denoted 604 and a ground feed is denoted 605. A second patch is denoted 606 and a third patch is denoted 607. The second patch is coupled through a first inductance 608 to the first protruding part 602 and the third patch 607 is coupled through a second inductance to the second protruding part 603. Thus is two separate, parallel radiating arms achieved which each can be tuned to different resonance frequencies as described. FIG. 6*b* disclose the arrangement in a more schematic view.

Figure 7A:
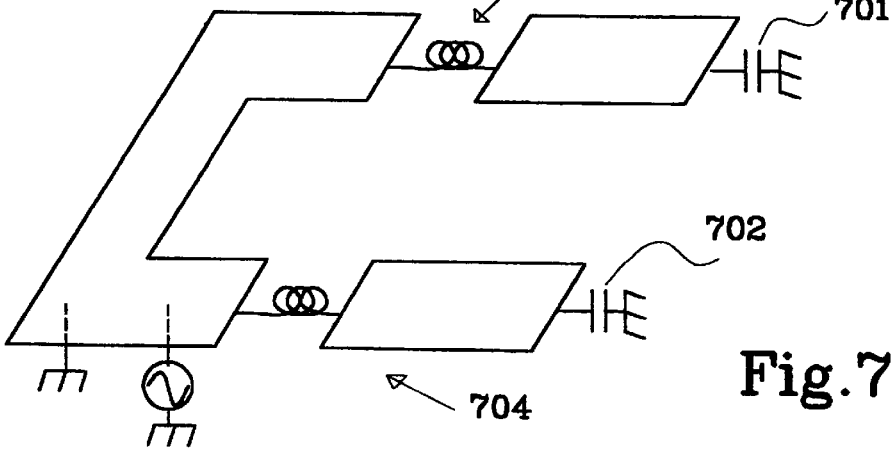
FIGS. 7*a*, 7*b*, 7*c*, 7*d* shows diagrammatic views of different variants according to the fourth embodiment of the invention.
Figure 7B:
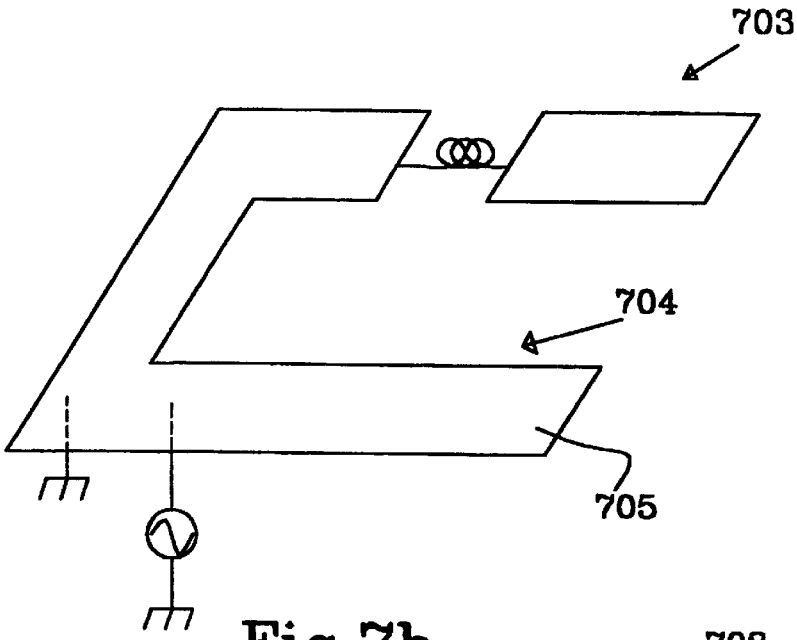
Figure 7C:
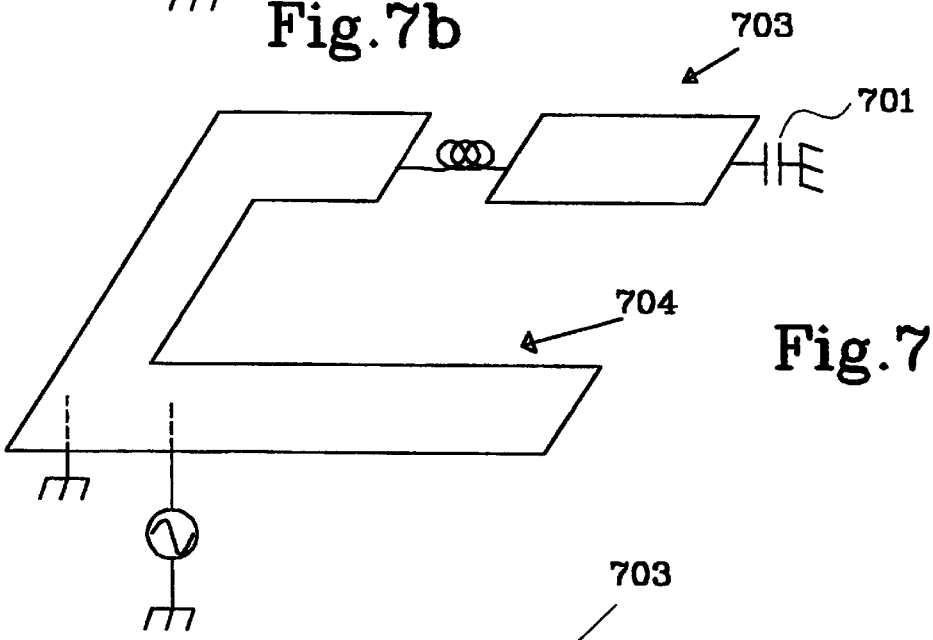
Figure 7D:
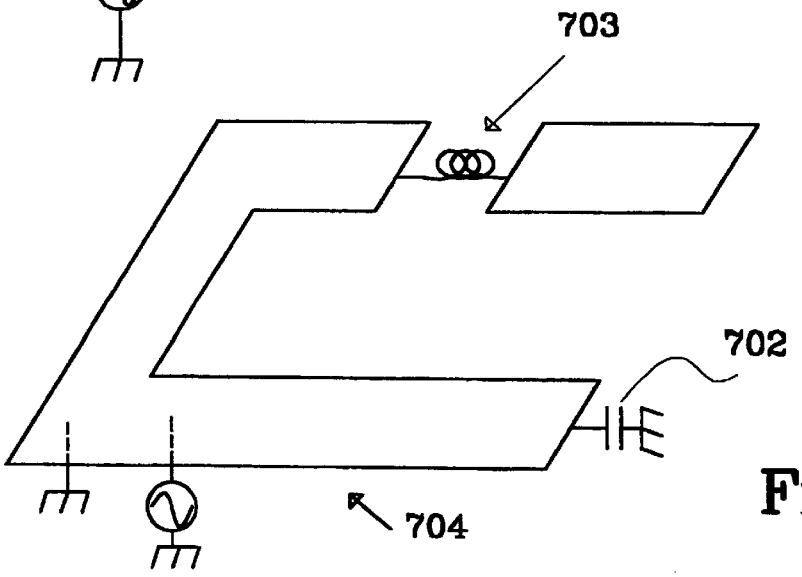

FIG. 7*a* shows a variant of the fourth preferred embodiment where first and second top capacitances, 701 and 702, are coupled to the first and second radiating arms, 703 and 704. In FIG. 7*b*, the second radiating arm is an elongated conductive strip 705 and no top capacitances are used. In FIG. 7*c*, the first radiating arm 703 comprises a top capacitance 701 and in FIG. 7*d*, the second radiating arm 704 comprises a top capacitance 702.

Figure 8A:
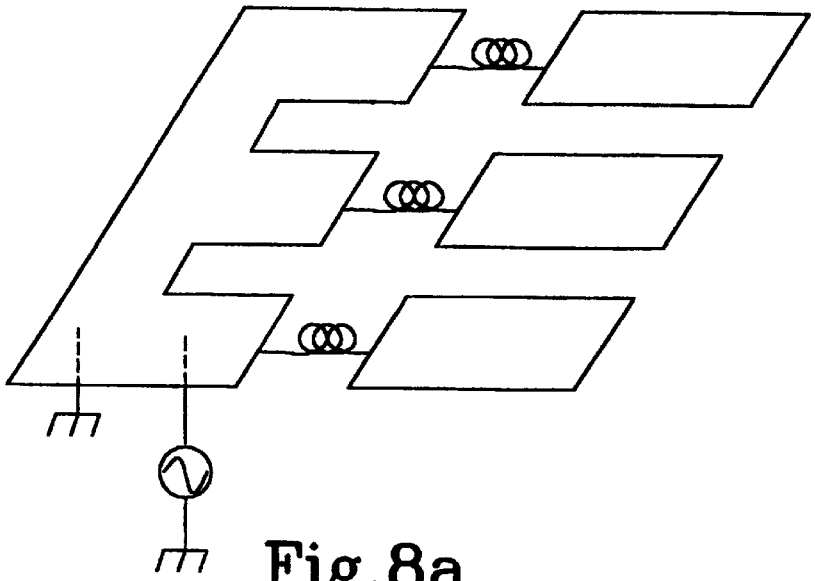
FIGS. 8*a*, 8*b*, 8*c* shows diagrammatic views of different variants according to a fifth embodiment of the invention.
Figure 8B:
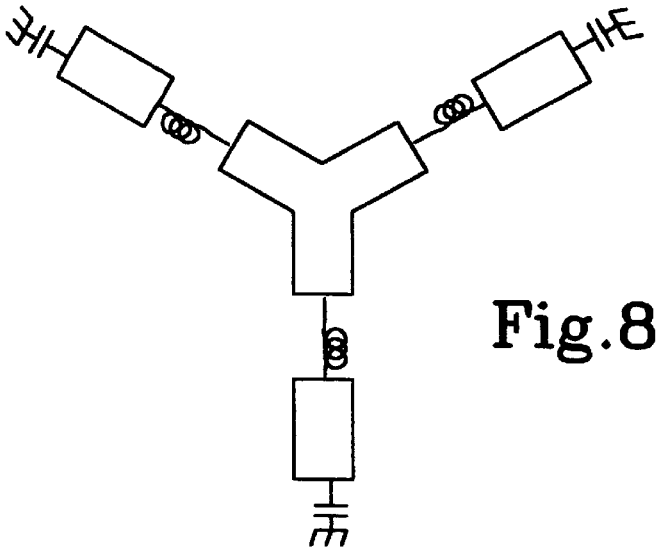
Figure 8C:
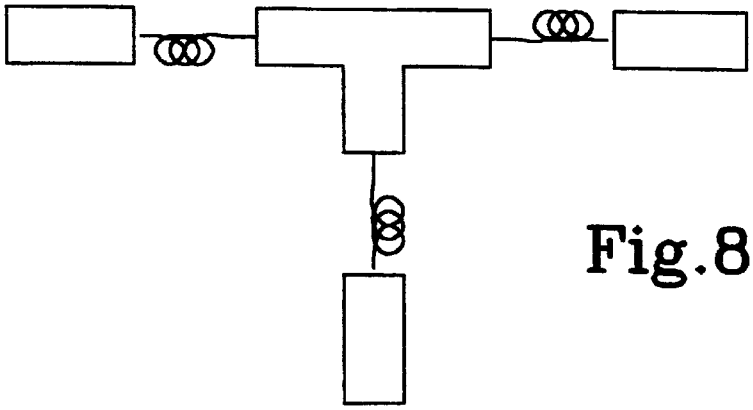

FIG. 8*a* shows a diagrammatic view according to a fifth preferred embodiment of the invention where three radiating arms are used. The arms are arranged in parallel and each radiating arm comprises inductive coupling. In FIG. 8*b*, the radiating arms are arranged in an Y-form, and in FIG. 8*c*, the arms are arranged in a T-form. Even though not shown, each individual radiating arm may or may not comprise a top capacitance to ground and even though each arm is shown comprising a inductive coupling, it is also possible to have individual arms as elongated conductive strips. Also the feeding is left out for sake of clarity as well as a possible short connecting the antenna to ground in FIGS. 8*b* and 8*c*.

Figure 9A:
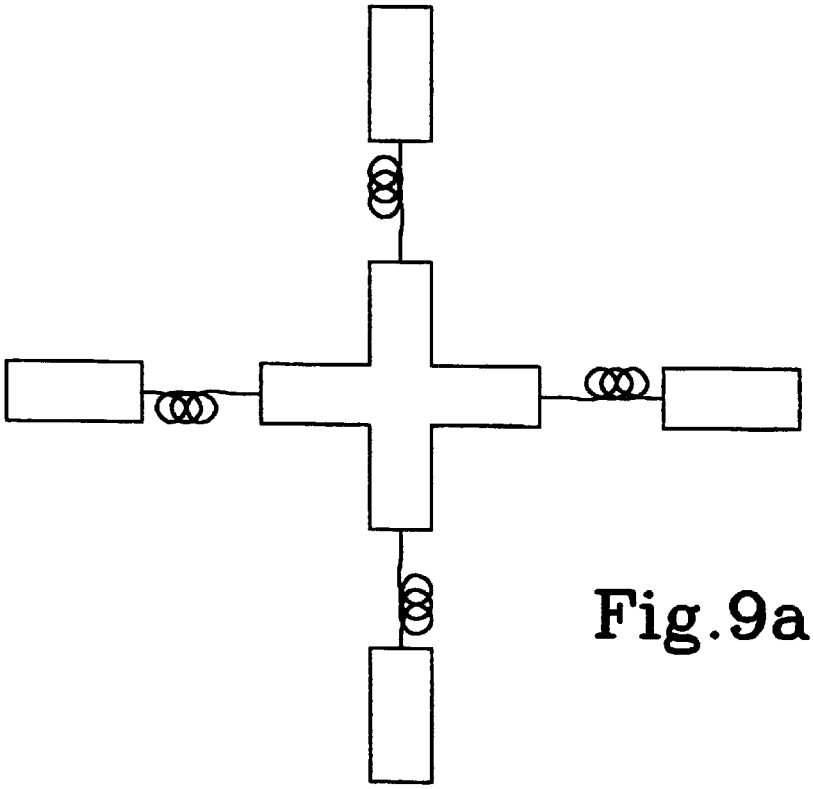
FIGS. 9*a*, 9*b* shows diagrammatic views of different variants according to a sixth embodiment of the invention.
Figure 9B:
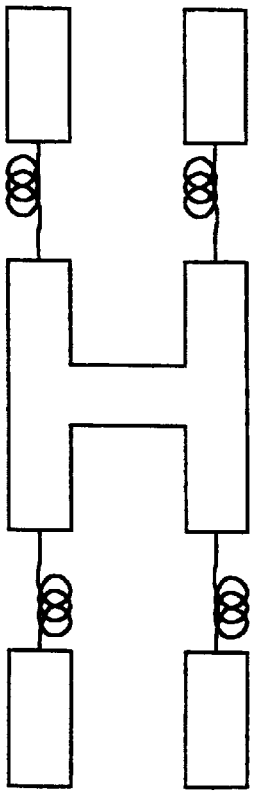

FIG. 9*a* shows a diagrammatic view according to a sixth preferred embodiment of the invention where four radiating arms are used. The radiating arms are arranged in a cross form and each radiating arm comprises inductive coupling. In FIG. 9*b* the radiating arms are arranged in a H-form. Also in this embodiment it is possible to use elongated conductive strips and/or top capacitances.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A microstrip antenna structure for receiving and transmitting radio frequency signals in at least two frequency bands, comprising:

a ground plane means, at least a first feeding means and,

N radiating elements where N is an integer number greater than zero, said microstrip antenna structure having a first conductive patch, said feeding means being arranged for feeding radio frequency signals to the first patch, at least a first of the N radiating elements having a second patch, inductive means for inductively coupling the second patch to said first patch and, said second patch having a free end.

2. The structure according to claim 1 wherein, said first and second patch being thin conductive layers on a dielectric carrier, said ground plane means substantially coextending with said N radiating means being arranged in proximity to the patches.

3. The structure according to claim 1 wherein, said second patch having a substantially rectangular shape.

4. The structure according to claim 1 wherein, said first and second patch being arranged at a specific distance from each other to attain, in addition to the inductive coupling, a capacitive coupling between the first and second patch with a specific capacitance.

5. The structure according to claim 1 wherein, first capacitive means being arranged for attaining in addition to the inductive coupling, a capacitive coupling said first patch to the second patch.

6. The structure according to claim 1 wherein, said inductive means is formed by at least one discrete component held by retainer means for inductively coupling said first and second patches to each other.

7. The structure according to claim 6 wherein, said retainer means comprise first and second protrusions arranged on a dielectric substrate for retaining the discrete component.

8. The structure according to claim 1 wherein,

N is equal to one and, said first patch being substantially rectangular.

9. The structure according to claim 1 wherein, at least a second of the N radiating elements is an elongated conductive strip having a free end.

10. The structure according to claim 1 wherein,

N is greater than one, said first conductive patch comprises at least a first protruding part, at least a second radiating element comprises a third substantially rectangular conductive patch, inductive means being arranged for inductively coupling said third patch to the first protruding part and, said third patch having a free end.

11. The structure according to claim 1 wherein, at least one of the N radiating elements having a capacitive coupling to the ground plane means at the free end, said capacitive coupling being adjusted to a specific capacitance.

12. The structure according to claim 11 wherein, a conductive extension means extending towards the ground plane means so as to attain the capacitive coupling.

13. The structure according to claim 11 wherein, said antenna structure further comprising a discrete component achieving the capacitive coupling.

14. The structure according to claim 1 wherein, said inductive means is a meandering conductive strip.

15. The structure according to claim 1 wherein, said inductive means is a coil.

16. The structure according to claim 1 wherein, said inductive means is a tunable, active inductor.

17. The structure according to claim 1 wherein, said N radiating elements being arranged substantially parallel to each other.

18. The structure according to claim 1 wherein,

N being three, said first patch having three protruding parts essentially forming a Y-shape and, first, second and third radiating elements extending from said protruding parts.

19. The structure according to claim 1 wherein,

N being three, said first patch having three protruding parts essentially forming a T-shape and, first, second and third radiating elements extending from said protruding parts.

20. The structure according to claim 1 wherein,

N being three, first and second radiating elements extending essentially parallel in a first direction and, a third radiating element extending in an opposite direction to the first direction.

21. The structure according to claim 1 wherein,

N being four, said first patch having four protruding parts essentially forming a cross shape and, first, second, third and fourth radiating elements extending from the protruding parts.

22. The structure according to claim 1 wherein,

N being four, said first patch having four protruding parts essentially forming a H-shape and, first, second, third and fourth radiating elements extending from said protruding parts.

23. The structure according to claim 1 wherein, coupling means being arranged for coupling the first patch to ground.

* * * * *